United States Patent [19]

Saito

[11] Patent Number: 4,783,675

[45] Date of Patent: Nov. 8, 1988

[54] IMAGE RECORDING METHOD

[75] Inventor: Minoru Saito, Kanagawa, Japan

[73] Assignee: Fuji Photo Film Co., Ltd., Kanagawa, Japan

[21] Appl. No.: 920,011

[22] Filed: Oct. 17, 1986

[30] Foreign Application Priority Data

Oct. 18, 1985 [JP] Japan ..... 60-233062

[51] Int. Cl.[4] ..... G03C 5/00

[52] U.S. Cl. ..... 354/303; 354/305; 354/317; 430/203; 430/403; 250/319

[58] Field of Search ..... 354/301, 303, 305, 317, 354/318; 430/203, 403; 250/317.1, 318, 319; 346/76 R, 76 PH, 137.1

[56] References Cited

U.S. PATENT DOCUMENTS

| | | | |
|---|---|---|---|
| 3,120,794 | 2/1964 | Gold | 354/301 |
| 3,827,906 | 8/1974 | Sato et al. | 354/317 |
| 4,013,360 | 3/1977 | Burke et al. | 354/301 |
| 4,526,455 | 7/1985 | Livingston | 354/303 |
| 4,620,096 | 10/1986 | Takehara et al. | 250/319 |
| 4,629,675 | 12/1986 | Takehara et al. | 354/303 |

FOREIGN PATENT DOCUMENTS 59-75247 4/1984 Japan .

*Primary Examiner*—A. A. Mathews

*Attorney, Agent, or Firm*—Sughrue, Mion, Zinn, Macpeak, and Seas

[57] ABSTRACT

An image recording method wherein an image recorded on a thermal developing photosensitive material is transferred to an image-receiving material in the presence of an image forming solvent so as to be formed on the image-receiving material. In this method, the image forming solvent is applied to only the whole or a part of that portion of either the thermal developing photosensitive material or the image-receiving material which is to be laid on the other, and the thermal developing photosensitive material and the image-receiving material are then laid one upon the other, thereby effecting the transfer of the image. Accordingly, transport means for transporting the thermal developing photosensitive material and/or the image-receiving material, such as a feed roller, can be prevented from being stained with the image forming solvent which might otherwise be applied in surplus.

21 Claims, 4 Drawing Sheets

IMAGE RECORDING METHOD

BACKGROUND OF THE INVENTION

1. Field of the Invention

The present invention relats to an image recording method wheriein an image recorded on a thermal developing photosensitive material is transferred to an image-receiving material in the presence of an image forming solvent, thereby recording the image o the image-receiving material.

2. Description of the Related Art

One type of image recording apparatus employs a thermal developing photosensitive material to obtain a color image. One example of this type of apparatus is shown in the specification of Japanese Patent Laid-Open No. 752/1984. In this known apparatus, an image is formed on a thermal developing photosensitive material by light exposure in an exposing section. The photosensitive material is then transported to a thermal developing section to effect thermal developmemt. Then, an image-receiving paper is brought into close contact with the thermally developed photosensitive material, and the developed image is transferred to the image-receiving paper by a transfer process.

Before being transported to the transfer section, the image-receiving paper is given a transfer assistant (i.e., an image forming solvent) such as water for the purpose of improving the transfer efficiency.

For this purpose, in the apparatus disclosed in the above-described specification of Japanese Patent Laid-Open No. 75247/1984, water is applied to the image-receiving paper by means of a roller soaked with water. With this arrangement, however, water is applied all over the image-receiving paper. Therefore, when the paper is brought into close contact with the photosensitive material for effecting transfer, surplus water is squeezed to overflow together with the emulsion coated on the image-carrying portion, thus causing a feed roller, a developing roller and the like to become stained.

SUMMARY OF THE INVENTION

In view of the above-described circumstances, it is a primary object of the present invention to provide an image recording method which enables an image forming solvent to be applied to only a necessary portion of either a thermal developing photosensitive material or an image-receiving material and thereby eliminates the fear of the applied image forming solvent causing transport means such as a feed roller, a developing roller and the like to be become stained.

To this end, the present invention provides an image recording method wherein an image recorded on a thermal developing photosensitive material is transferred to an image-receiving material in the presence of an image forming solvent so as to be formed on the image-receiving material, comprising: the step of applying the image forming solvent to only the whole or a part of that portion of either the thermal developing photosensitive material or the image-receiving material which is to be laid on the other; and the step of laying the thermal develoing photosensitive material and the image-receiving material one upon the other, thereby effecting the transfer of the image.

Thus, according to the present invention, no image forming solvent is applied to any portion other than that portion of either the thermal developing photosensitive material or the image-receiving material which is to be laid on the other. It is therefore possible to eliminate the fear of surplus solvent causing a guide plate, a guide roller and the like to become stained during the transfer and separation steps.

The application of the image forming solvent may be effected by allowing an applicator member having water absorption properties, such as a felt member, to come in and out of contact with the image-carrying surface of the thermal developing photosensitive material, or employing solvent spray means such as an ink jet means.

The image recording apparatus to which the present invention is applied may have a thermal developing section and a transfer section which are provided separately from each other, the thermal developing section being adapted to develop thermally a thermal developing photosensitive material having an image formed thereon by light exposure, and the transfer section being adapted such that the thermally developed photosensitive material and an image-receiving material are laid one upon the other and heated to transfer the image formed on the photosensitive material to the image-receiving material. Alternatively, the thermal developing section and the transfer section may be provided at the same position, that is, the image recording apparatus may be provided with a thermal developing/transfer section in which a thermal developing photosensitive material having been subjected to light exposure and an image-receiving material are laid one upon the other and heated to effect thermal development and heat transfer at the same time.

It should be noted that the applicator member having water absorption properties in the present invention is only required to be made of a water absorbent material which is able to retain an image forming solvent such as water even in a small amount, and it is possible to employ, for example, porous materials such as sponge and expanded material, felt material, and hairy material.

The image forming solvent employed in the present invention is a solvent which is necessary for forming a image. Examples include water, low-boiling point organic solvents (alcohol, ketones, amides, etc.), and mixtures obtained by adding various adders such as a surface-active agent, a development accelerator and a development stopper to the above-described solvents.

DESCRIPTION OF THE PREFERRED EMBODIMENT

One embodiment of the image recording method according to the present invention will be described hereinunder by way of an example in which thermal development and heat transfer are effected simultaneously.

Figure 1:
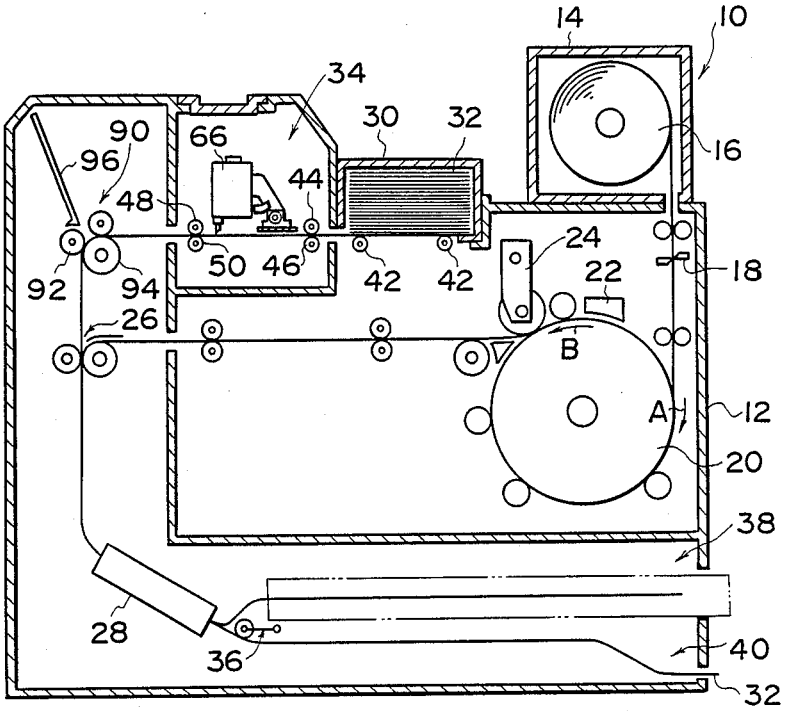
FIG. 1 is a sectional view of an image recording apparatus to which one embodiment of the image recording method according to the present invention is applied.

FIG. 1 shows an image recording apparatus 10 to which one embodiment of the present invention is applied.

In this image recording apparatus 10, a magazine 14 accommodating a thermal developing photosensitive material 16 is mounted on a machine frame 12. The photosensitive material 16 which is unwound from the magazine 14 is cut into a necessary length by a cutter 18 and transported in the direction of the arrow A so as to be wound around the outer periphery of an exposing drum 20 installed inside the machine frame 12. The photosensitive material 16 is then subjected to light exposure by an exposing head 22, and transported in the opposite direction (the direction of the arrow B) so as to be separated from the outer periphery of the exposing drum 20 by a scraper 24 and sent to an overlaying section 26.

Image-receiving sheets of paper 32 are accommodated in layers within a cassette 30 and supplied one by one through a water applicator section 34. The image-receiving sheet 32 is laid on the photosensitive material 16 at the overlaying section 26 and transported to a thermal developing/transfer section 28. A separating section 36 is provided on the downstream side of the section 28. On the downstream side of the separating section 36, the photosensitive material 16 is transported to an accommodating means 38, and the image-receiving paper 32 is sent to a delivery section 40.

The image-receiving sheets of paper 32 which are accommodated in the cassette 30 are subjected to driving force applied from feed rollers 42 rotatably supported by the machine frame 12, so that the lowermost sheet is delivered to the water applicator section 34.

The water applicator section 34 will be explained below in detail with reference to FIGS. 2 to 4.

In the water applicator section 34, a pair of feed rollers 44, 46 adapted to feed the image-receiving paper 32 held therebetween are disposed in close proximity with the cassette 30. A pair of feed rollers 48, 50 are disposed on the downstream side of these feed rollers 44, 46 in such a manner that they feed the image-receiving paper 32 held therebetween. These rollers are rotated by the driving force derived from a motor (not shown) so as to transport the image-receiving paper 32 toward the overlaying section 26. Between these pairs of feed rollers, a guide plate 51 is provided in opposing relation to the reverse side (the side opposite to the emulsion-coated side) of the image-receiving paper 32 being transported.

Figure 4:
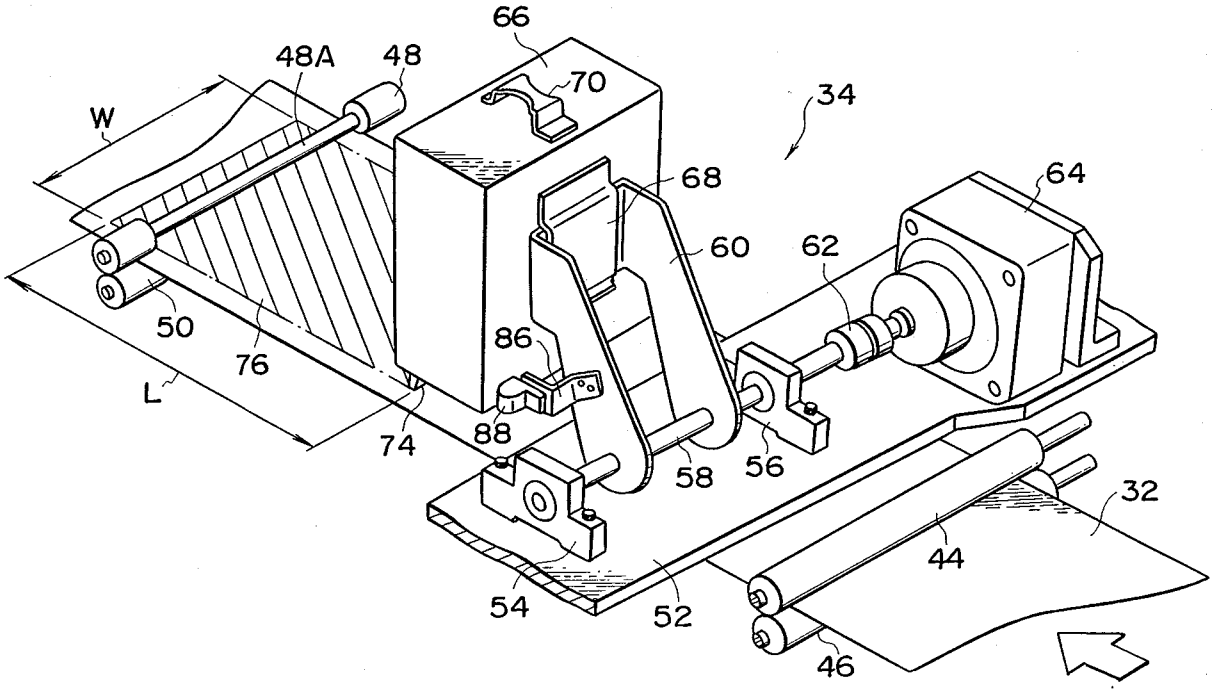
FIG. 4 is a perspective view showing the water applicator section in the application position.

As also shown in FIG. 4, a bracket 52 is stretched between the feed rollers 44 and 48 in such a manner that the bracket 52 is positioned in close proximity with the image transfer surface, that is, the emulsion-coated side, of the transported image-receiving paper 32. A rotary shaft 58 is rotatably supported on the bracket 52 through a pair of bearings 54, 56. A pivoting arm 60 is rigidly secured to the rotary shaft 58. The pivoting arm 60 is formed from a plate material in such a manner that two end portions of the plate material are bent at right angle so as to extend parallel with each other, the arm 60 being rigidly secured at these extended portions to the rotary shaft 58.

Figure 2:
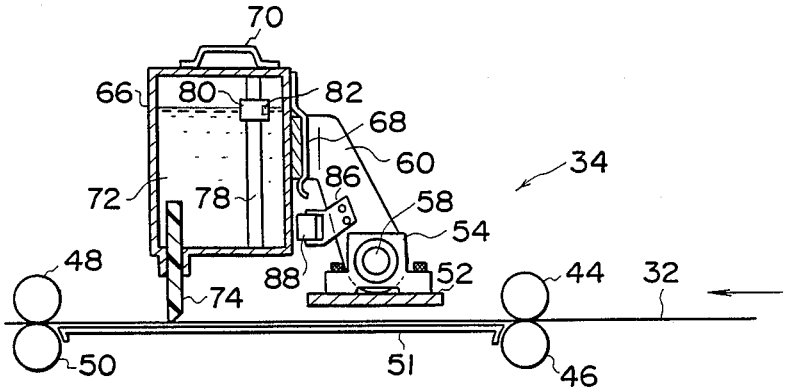
FIG. 2 is an enlarged sectional view showing the water applicator section of the image recording apparatus in the application position.
Figure 3:
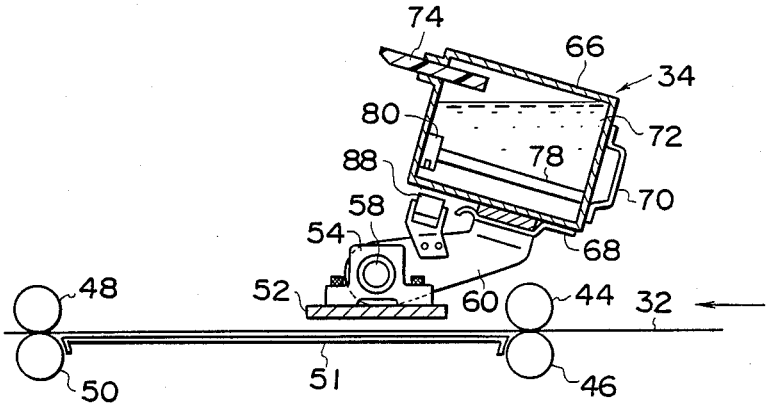
FIG. 3 shows the water applicator section in the retraction position.

One end portion of the rotary shaft 58 which projects from the bearing 56 is connected to a motor 64 through a coupling 62, so that the shaft 58 which is subjected to the rotational force from the motor 64 can make the arm 60 pivot between the position shown in FIG. 2 and the position shown FIG. 3.

A clip 68 is rigidly secured at one end thereof to one side wall of a tank 66 and fitted on the central portion of the pivoting arm 60, whereby the tank 66 is mounted on the arm 60. A handle 70 is provided on the top of the tank 66. When an operator holds this handle 70 and raises it upwardly from the position shown in FIG. 2 or 4, the clip 68 comes off the pivoting arm 60, thereby allowing the tank 66 to be removed. For this purpose, the clip 68 is preferably made of a leaf spring material.

As shown in FIG. 2, the tank 66 contains water 72 which serves as an image forming solvent. The water 72 is applied to the surface of the image-receiving paper 32 through a porous felt member 74. More specifically, one end of the felt member 74 is inserted into the tank 66, while the distal end portion, that is, an applicator portion, of the felt member 74 which projects from the tank 66 is brought into contact with the surface of the image-receiving paper 32 as shown in FIGS. 2 and 4, and in this state, the felt member 74 can apply the water impregnated therein to the central portion of the surface of the image-receiving paper 32 (this position will hereinafter be referred to as the "application position"). In the state shown in FIG. 3, since the felt material 74 is separated from the image-receiving paper 32, no application of water is effected (this position will hereinafter be referred to as the "retraction position"), and the inner end of the felt member 74 is separated from the water 72 contained in the tank 66.

It should be noted that, to enable the tank 66 to be accurately stopped at the application position shown in FIG. 2 and the retraction position shown in FIG. 3, it is only necessary to control the angle of rotation of the motor 64 or provide a stopper which abuts against the pivoting arm 60 or any other appropriate member or portion.

Figure 5:
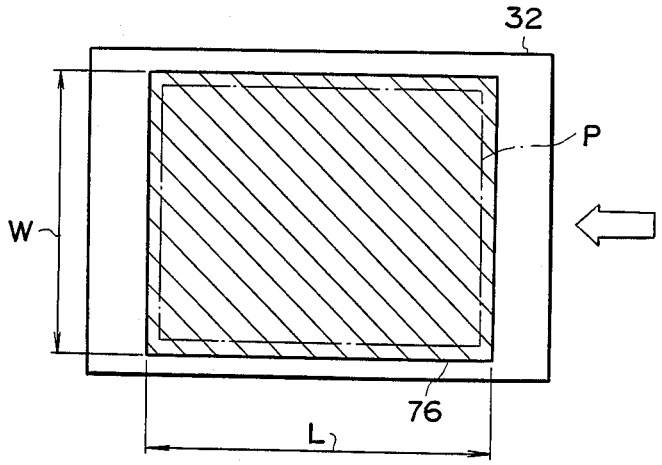
FIG. 5 is a plan view of an image-receiving paper coated with water.

The hatched portion shown in FIGS. 4 and 5 represents the water 76 applied by the felt member 74. The width W of the applied water 76 can be adjusted as desired by varying the the width of the felt member 74. Accordingly, it is possible to apply the water 76 to the image-receiving paper 32 over an area which is within a range in which the paper 32 is to be laid on the photosensitive material 16 and which area is set such as to be slightly larger than an image transfer area P so that a possible error can be absorbed.

In addition, the arrangement may be such that the felt member 74 is brought into contact with the surface of the image-receiving paper 32 through a plate-like mask which covers any portion of the image-receiving paper 32 which need not be coated with water.

In order to prevent any adverse effect on the applied water 76, the feed roller 48 is reduced in diameter at the central portion thereof to define a smaller-diameter portion 48A, so that the feed rollers 48 and 50 hold therebetween only the lateral edge portions of the image-receiving paper 32.

A guide rod 78 is mounted within the tank 66 in such a manner that the axis of the guide bar 78 extends vertically when the water applicator section 34 is in the application position shown in FIG. 2. A float 80 is provided in such a manner as to be movable along the guide rod 78. A magnet 82 is attached to a part of this float 80, so that the magnet 82 moves up and down, together with the float 80, in response to changes in the level of the water 72 contained in the tank 66.

A magnetic sensor 88 is rigidly secured to the pivoting arm 60 through a mounting plate 86 in such a manner that the sensor 88 opposes the magnet 82. Thus, when the water applicator section 34 is in the water application position shown in FIG. 2, and when the magnet 82 reaches a predetermined level or height, the magnetic sensor 88 detects the position of the magnet 82, that is, the level of the water 72, and informs the operator of the shortage of the water 72 in the tank 66 by means of an alarm or the like (not shown). In such case, the operator can supply a necessary amount of water into the tank 66 or replace the tank 66 with another tank 66.

It should be noted that various types of sensor can be employed to detect the amount of water 72 contained in the tank 66. For example, the tank 66 may be made transparent so that the liquid level can be visually checked from the outside.

When the water applicator section 34 is in the retraction position shown in FIG. 3, the tank 66 is pivoted clockwise from the application position, and the felt member 74 is thereby positioned above the level of the water 72. Consequently, the water 72 is not in contact with the felt member 74, so that it is possible to reduce the amount of water 72 vaporizing to the outside through the felt member 74 when the water applicator section 34 is in the retraction position.

As shown in FIG. 1, on the downstream side of the water applicator section 34 is provided an inverting section 90 adapted such that the emulsion-coated side of the image-receiving paper 32 which has been coated with water is made to face the image-carrying side of the photosensitive material 16. In this inverting section 90, the image-receiving paper 32 delivered from the water applicator section 34 is pushed out onto a tray 96 from the leading end of the paper 32 by means of guide rollers 92 and 94. In this case, the guide roller 92 is separated from the guide roller 94 and rotatated in the same direction as that of the rotation of the roller 94. After the image-receiving paper 32 has properly been pushed out, the guide roller 92 is brought into contact with the guide roller 94, and the tail end of the image-receiving paper 32 is held therebetween. In this state, the image-receiving paper 32 is fed toward the overlaying section 26 from the tail end which now serves as the leading end, whereby the water-coated side is allowed to face the image-carrying side of the photosensitive material 16.

The operation of this embodiment will be explained below.

The thermal developing photosensitive material 16 drawn out from the magazine 14 is wound around the exposing drum 20 and subjected to light exposure by the exposing head 22 before being sent to the overlaying section 26.

Among the image-receiving sheets of paper 32 accommodated in the cassette 30, the lowermost sheet of paper 32 is transported to the water applicator section 34 by means of the feed rollers 42. In the water applicator section 34, the motor 64 is activated to rotate in synchonism with the transportation of the image-receiving pape 32 so as to bring the tank 66 into the application position shown in FIG. 2. As the image-receiving paper 32 advances, water is applied to the surface of the paper 32, and when a necessary amount of water has been applied, the motor 64 is rotated again so as to cause the tank 66 to pivot to the retraction position shown in FIG. 3.

Thus, it is possible to control as desired the length L of the applied water 76 along the longitudinal direction of the image-receiving paper 32 as shown in FIG. 4. Since the width W of the applied water 76 is controlled by the width of the felt member 74, the water 76 can be applied to only an image transfer portion which needs to be coated with the water 76. The water 76 thus applied passes under the smaller-diameter portion 48A of the feed roller 48, and there is therefore no fear of the applied water 76 being adversely affected by the feed roller 48.

The image-receiving paper 32 coated with water in the water applicator section 34 is inverted in the inverting section 90, delivered to the overlaying section 26 where it is laid on the photosensitive material 16 in such a manner that the water-coated side of the paper 32 faces the image-carrying side of the photosensitive material 16, and then transported to the thermal developing/transfer section 28. In the section 28, thermal development is carried out in the presence of water and, at the same time, the dye image thus formed is heat-transferred to the emulsion-coated side of the image-receiving paper 32. Since a necessary amount of water has already been applied to the image-receiving paper 32 in an appropriate state, it is possible to conduct an extremely excellent transfer operation. In addition, there is no fear of unnecessary surplus water causing the guide roller and the like to become stained.

After the completion of the transfer operation, the photosensitive material 16 and the image-receiving paper 32 which remain in close contact with each other are sent from the thermal developing/transfer section 28 to the separating section 36 from which the photosensitive material 16 is deposited in the accommodating means 38 and the image-receiving paper 32 is transported to the delivery section 40 so as to be taken out of the apparatus 10.

Although in the above-described embodiment the present invention is applied to an arrangement in which water is applied to the image-receiving paper 32, it is also possible to apply the present invention to an arrangement in which water is applied to the photosensitive material 16.

In the above-described embodiment, the felt member 74 is moved from the application position to the retraction position by pivoting the tank 66 through the arm 60. This arrangement is, however, not necessarily limitative, and the tank 66 may be linearly moved away from the image-receiving paper 32 to separate the felt member 74 therefrom. In addition, the arrangement may be such that the felt member 74 is adapted to be movable alone relative to the tank 66 so as to move away from the image-receiving paper 32.

Although a felt member is employed for application of a solvent in the above-described embodiment, other applicator means may be employed such as an ink jet means which sprays a solvent in the form of a mist. In such case, a mask may be employed in order to prevent application of the solvent to any unnecessary portion.

In the above-described embodiment, the felt member 74 is at rest, while the image-receiving paper 32 advances to cause relative movement therebetween. However, the felt member 74 may be driven to move in the direction in which the image-receiving paper 32 advances so that both of them move relative to each other.

As has been described above, the present invention provides an image recording method wherein an image recorded on a thermal developing photosensitive material is transferred to an image-receiving material in the presence of an image forming solvent so as to be formed on the image-receiving material, characterized in that the image forming solvent is applied to only the whole or a part of that portion of either the thermal developing photosensitive material or the image-receiving material which is to be laid on the other. Accordingly, transport means for transporting the thermal developing photosensitive material and/or the image-receiving material, such as a feed roller and a developing roller, can be prevented from being stained with the image forming solvent which might otherwise be applied in surplus.

What is claimed is:

1. An image recording method wherein an image recorded on a thermal developing photosensitive material is transferred to an image-receiving material in the presence of an image forming solvent so as to be formed on the image-receiving material, comprising:

(a) the step of applying said image forming solvent to only the whole or a part of that portion of either said thermal developing potosensitive material or said image-receiving material which is to be laid on the other; and (b) the step of laying said thermal developing photosensitive material and said image-receiving material one upon the other, thereby effecting said transfer of the image, whereby by transport means for transporting said thermal developing photosensitive material and/or said image-receiving material can be prevented from being stained with said image forming solvent which might otherwise be applied in surplus;

said application of said image forming solvent is effected by moving an applicator member having water absorbing properties and either said thermal developing photosensitive material of said image-receiving material relative to each other and allowing the former to come in and out of contact with the latter;

(c) the step of inverting either said thermal developing photosensitive material or said image-receiving material, which is coated with said image forming solvent, said inverting step being carried out between said steps (a) and (b), (d) the step of separating said thermal developing photosensitive material and said image-receiving material from each other, after said step (b).

2. An image recording method according to claim 1, further comprising the step of exposing said thermal developing photosensitive material, before said step (b).

3. An image recording method according to claim 2, wherein said exposing step is carried out in such a manner that said thermal developing photosensitive material is wound on an exposing drum being rotated in one direction and is then subjected to light exposure by means of an exposing head.

4. An image recording method according to claim 3, wherein said exposed thermal developing photosensitive material is sent to said step (b) by rotating said exposing drum in the other direction.

5. An image recording method according to claim 4, wherein, in said step (a), said image forming solvent is applied to either said image-receiving material or said thermal developing photosensitive material over an area which is within a range in which said image-receiving material and said thermal developing photosensitive material are to be laid one upon the other and which area is larger than an image transfer area by a predetermined range.

6. An image recording method wherein an image recorded on a thermal developing photosensitive material is transferred to an image-receiving material in the presence of an image forming solvent so as to be formed on the image-receiving material, comprising:

the application step of applying said image forming solvent to only the whole or a part of that portion of said image-receiving material which is to be laid on said thermal developing photosensitive material; and the transfer step of laying said thermal developing photosensitive material and said image-receiving material one upon the other, thereby transferring the image to said image-receiving material, whereby transport means for transporting said thermal developing photosensitive material and/or said image-receiving material can be prevented from being stained with said image forming solvent which might otherwise be applied in surplus; and the step of separating said thermal developing photosensitive material and said image-receiving material from each other, after said transfer step, the step of inverting said image-receiving material coated with said image forming solvent in such a manner that the emulsion-coated side of said image-receiving material faces the image-carrying side of said thermal developing photosensitive material, said inverting step being carried out between said application and transfer steps.

7. An image recording method according to claim 6, wherein said transfer step includes the overlaying step of laying said thermal developing photosensitive material and said image-receiving material one upon the other, and the step of transferring the image to said image-receiving material.

8. An image recording method according to claim 6, further comprising the step of exposing said thermal developing photosensitive material, before said transfer step.

9. An image recording method according to claim 8, wherein said exposing step is carried out in such a manner that said thermal developing photosensitive material is wound on an exposing drum being rotated in one direction an is then subjected to light exposure by means of an exposing head.

10. An image recording method according to claim 9, wherein said exposed thermal developing photosensitive material is sent to said overlaying step by rotating said exposing drum in the other direction.

11. An image recording method according to claim 10, wherein, in said transfer step, said thermal developing photosensitive material is developed thermally, and the image is heat-transferred to the emulsion-coated side of said image-receiving material.

12. An image recording method according to claim 11, wherein, in said application step, said image forming solvent is applied to said image-receiving material over an area which is within a range in which said image-receiving material and said thermal developing photosensitive material are laid one upon the other and which area is larger than an image transfer area by a predetermined range.

13. An image recording method according to claim 12, wherein the application of said image forming solvent is effected by moving an applicator member having water absorbing properties and said image-receiving material relative to each other and allowing the former to come in and out of contact with the latter.

14. An image recording method wherein an image recorded on a thermal developing photosensitive material is transferred to an image-receiving material in the presence of an image forming solvent so as to be formed on the image-receiving material, comprising:

(a) the step of applying said image forming solvent to only the whole or a part of that portion of either said thermal developing photosensitive material or said image-receiving material which is to be laid on the other; and (b) the step of laying said thermal developing photosensitive material and said image-receiving material one upon the other, thereby effecting said transfer of the image, whereby transport means for transporting said thermal developing photosensitive material and/or said image-receiving material can be prevented from being stained with said image forming solvent which might otherwise be applied in surplus;

said application of said image forming solvent is effected by moving an applicator member having water absorbing properties and either said thermal developing photosensitive material or said image-receiving material relative to each other and allowing the former to come in and out of contact with the latter;

(c) the step of exposing said thermal developing photosensitive material, before said step (b) said exposing step being carried out in such a manner that said thermal developing photosensitive material is wound on an exposing drum being rotated in one direction and is then subjected to light exposure by means of an exposing head; and (d) the step of separating said thermal developing photosensitive material and said image-receiving material from each other, after said step (b).

15. An image recording method according to claim 14, wherein said exposed thermal developing photosensitive material is sent to said step (b) by rotating said exposing drum in the other direction.

16. An image recording method according to claim 15, wherein, in said step (a), said image forming solvent is applied to either said image-receiving material or said thermal developing photosensitive material over an area which is within a range in which said image-receiving material and said thermal developing photosensitive material are to e laid one upon the other and which area is larger than an image transfer area by a predetermined range.

17. An image recording method wherein an image recorded on a thermal developing photosensitive material is transferred to an image-receiving material in the presence of an image forming solvent so as to be formed on the image-receiving material, comprising:

the application step of applying said image forming solvent to only the whole or a part of that portion of said image-receiving material which is to be laid on said thermal developing photosensitive material; and the transfer step of laying said thermal developing photosensitive material and said image-receiving material one upon the other, thereby transferring the image to said image-receiving material, whereby transport means for transporting said thermal developing photosensitive material and/or said image-receiving material can be prevented from being stained with said image forming solvent with might otherwise be applied in surplus;

the step of separating said thermal developing photosensitive material and said image-receiving material from each other, after said transfer step; and the step of exposing said thermal developing photosensitive material, before said transfer step, said exposing step being carried out in such a manner that said thermal developing photosensitive material is wound on an exposing drum being rotated in one direction and is then subjected to light exposure by means of an exposing head.

18. An image recording method according to claim 17, wherein said exposed thermal developing photosensitive material is sent to said overlaying step by rotating said exposing drum in the other direction.

19. An image recording method according to claim 18, wherein, in said transfer step, said thermal developing photosensitive material is developed thermally, and the image is heat-transferred to the emulsion-coated side of said image-receiving material.

20. An image recording method according to claim 19, wherein, in said application step, said image forming solvent is applied to said image-receiving material over an area which is within a range in which said image-receiving material and said thermal developing photosensitive material are laid one upon the other and which area is larger than an image transfer area by a predetermined range.

21. An image recording method according to claim 20, wherein the application of said image forming solvent is effected by moving an applicator member having water absorbing properties and said image-receiving material relative to each other and allowing the former to come in and out of contact with the latter.

* * * * *